US012344981B2

(12) United States Patent
Kim

(10) Patent No.: US 12,344,981 B2
(45) Date of Patent: Jul. 1, 2025

(54) WASHING MACHINE AND CONTROL METHOD OF WASHING MACHINE

(71) Applicant: LG Electronics Inc., Seoul (KR)

(72) Inventor: Han Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 574 days.

(21) Appl. No.: 17/624,723

(22) PCT Filed: Jun. 26, 2020

(86) PCT No.: PCT/KR2020/008393

§ 371 (c)(1),
(2) Date: Jan. 4, 2022

(87) PCT Pub. No.: WO2021/002640

PCT Pub. Date: Jan. 7, 2021

(65) Prior Publication Data

US 2022/0251751 A1 Aug. 11, 2022

(30) Foreign Application Priority Data

Jul. 4, 2019 (KR) ..... 10-2019-0080611

(51) Int. Cl.

| | |
|---|---|
| ***D06F 35/00*** | (2006.01) |
| ***D06F 33/34*** | (2020.01) |
| ***D06F 33/40*** | (2020.01) |
| ***D06F 33/44*** | (2020.01) |
| ***D06F 39/04*** | (2006.01) |
| ***D06F 39/08*** | (2006.01) |
| *D06F 105/02* | (2020.01) |
| *D06F 105/10* | (2020.01) |
| *D06F 105/48* | (2020.01) |

(52) U.S. Cl.

CPC ..... *D06F 33/34* (2020.02); *D06F 33/40* (2020.02); *D06F 33/44* (2020.02); *D06F 39/04* (2013.01);

(Continued)

(58) Field of Classification Search

CPC ..... D06F 33/32; D06F 33/34; D06F 33/36; D06F 33/38; D06F 33/40; D06F 33/44;

(Continued)

(56) References Cited

U.S. PATENT DOCUMENTS

2008/0201867 A1 8/2008 Bang et al.
2009/0056037 A1 3/2009 Lee et al.

(Continued)

FOREIGN PATENT DOCUMENTS

EP 2754743 5/2016
EP 2728048 1/2017

(Continued)

OTHER PUBLICATIONS

Machine Translation of Im et al., KR 2018-072336 A, Jun. 2018. (Year: 2018).*

(Continued)

*Primary Examiner* — David G Cormier

(74) *Attorney, Agent, or Firm* — Fish & Richardson P.C.

(57) ABSTRACT

A control method for a washing machine includes a first drum operation of supplying water by a first set amount with a detergent into a tub and rotating a drum at a first drum rotation speed while supplying water and operating a pump at a first pump rotation speed, a second drum operation of operating a heater to heat the water in the tub having the first set amount of water, rotating the drum at the first drum rotation speed during the operation of the heater, and operating the pump at the first pump rotation speed, rotating the drum at a preset spin-drying speed to spin-dry laundry, operating the drum at a second drum rotation speed greater than the first drum rotation speed while supplying water, after the operation of spin-drying the laundry, and accelerating the pump from the second pump rotation speed to a third pump rotation speed.

14 Claims, 6 Drawing Sheets

(52) U.S. Cl.
CPC ..... *D06F 39/085* (2013.01); *D06F 2105/02* (2020.02); *D06F 2105/10* (2020.02); *D06F 2105/48* (2020.02)

(58) Field of Classification Search
CPC ..... D06F 33/46; D06F 35/005; D06F 35/006; D06F 39/04; D06F 39/083; D06F 39/085; D06F 2105/02; D06F 2105/06; D06F 2105/10; D06F 2105/48
See application file for complete search history.

(56) References Cited

U.S. PATENT DOCUMENTS

| | | | | |
|---|---|---|---|---|
| 2012/0210518 | A1* | 8/2012 | Bae | D06F 33/36 8/137 |
| 2015/0299926 | A1 | 10/2015 | Kim et al. | |

FOREIGN PATENT DOCUMENTS

| | | |
|---|---|---|
| JP | 2012-170694 | 9/2012 |
| KR | 10-2017-0049213 | 5/2017 |
| KR | 10-2018-0072336 | 6/2018 |
| KR | 10-2018-0076565 | 7/2018 |
| KR | 10-2019-0006057 | 1/2019 |

OTHER PUBLICATIONS

Machine Translation of Kim et al., KR 2017-049213 A, May 2017. (Year: 2017).*
International Search Report in International Appln. No. PCT/KR2020/008393, mailed Oct. 15, 2020, 5 pages (with English translation).
Extended European Search Report in European Appln. No. 20834985.2, mailed on Jun. 16, 2023, 10 pages.

* cited by examiner

FIG. 6

| cycle | washing cycle(S1) | | first rinsing cycle(S2) | | | | | first rinsing cycle(S3) | | spin-dry cycle(S4) |
|---|---|---|---|---|---|---|---|---|---|---|
| | washing water supply(S11) | heat washing (S12) | rinse and spin-dry (S21) | water supply (S22) | rinse (S23) | water supply (S24) | hygiene (S25) | drain (S31) | water supply (S32) | main spin-dry (S41) |
| time | 4 minutes | 6 minutes | 8 minutes | 40 seconds | 40 seconds | 40 seconds | 1 minute | 1 minute | 2 minute | 8 minute |
| drum operation method | rolling | rolling | spin-dry rotation | filtration | filtration | filtration | filtration | | tumbling | spin-dry rotation |
| drum rotation speed (rpm) | 36 | 36 | 750 | 108 | 108 | 108 | 150(30") 130(30") | | 46 | 750 |
| actual operation rate of washing motor | 30"/4" | 30"/4" | | | | | | | 25"/9" | |
| actual operation rate of circulation pump | synchronization with washing motor | 14"/4" | synchronization with washing motor | synchronization with washing motor | | | | | synchronization with washing motor | |
| circulation pump operation method | constant speed operation, 1.1A | constant speed operation, 1.1A | | lifting operation 0.3~1.1A | | | | | speed shifting operation, 0.5~1.1A | |
| water supply amount(L) | 12 | | 29 | | | | | 32 | | |

WASHING MACHINE AND CONTROL METHOD OF WASHING MACHINE

CROSS-REFERENCE TO RELATED APPLICATIONS

This application is a National Stage application under 35 U.S.C. § 371 of International Application No. PCT/KR2020/008393, filed on Jun. 26, 2020, which claims the benefit of Korean Patent Application No. 10-2019-0080611, filed on Jul. 4, 2019. The disclosures of the prior applications are incorporated by reference in their entirety.

BACKGROUND OF THE DISCLOSURE

Field of the Disclosure

The present disclosure relates to a washing machine and a control method of a washing machine, and more particularly, to a washing machine in which washing performance is improved by controlling a speed of a circulation pump, and a control method of a washing machine.

Related Art

Japanese Patent Application Laid-Open No. 2010-36016 (hereinafter referred to as a "related art") discloses a washing machine having a rotating drum installed in a water tank and having a circulation pump for circulating water discharged from the water tank. The circulation pump is capable of controlling a rotational speed, and a degree to which circulating water discharged into the drum is spread is adjusted according to a rotational speed of the circulation pump.

Meanwhile, for effective washing, a physical action such as a fall of laundry caused by the rotation of the drum and friction between the laundry and the drum or lifter and a chemical action by a detergent are important.

SUMMARY

The present disclosure provides a control method of a washing machine having improved washing performance using a circulation pump with variable speed.

The present disclosure also provides a control method of a washing machine capable of deriving optimum washing performance within a short time by optimizing an operation of a circulation pump and a rotation pattern of a drum.

The present disclosure relates to a washing machine having a drum rotating in a tub and a nozzle spraying water discharged from the tub and circulated by a pump into the drum, and a control method of a washing machine.

The washing machine may include a tub for storing water, a drum rotatably provided in the tub, a driving unit rotating the drum, a water supply unit supplying water supplied from an external water source to the tub, a pump having a pump motor and pressure-feeding water discharged from the tub, a nozzle spraying the water pressure-fed by the pump into the drum, a heater heating the water in the tub, and a controller controlling the driving unit, the water supply unit, and the pump motor, and the heater.

The washing machine may further include a casing forming an exterior of the washing machine. The tub may be disposed in the casing. The casing may include a cabinet having an open front surface, a left surface, a right surface, and a rear surface.

A central axis of rotation on which the drum rotates may be disposed on a straight line passing through the rear surface of the cabinet. The drum may be rotated about a horizontal axis of rotation in the tub.

The nozzle may be provided in plurality.

The water supply unit may include a water supply pipe receiving water from an external water source, a water supply valve controlling the water supply pipe, and a dispenser accommodating a detergent. The dispenser may be connected to the water supply pipe and the tub.

The controller may control the water supply unit to supply water by a first set amount to the tub. The controller may control the driving unit so that the drum rotates at a first drum rotation speed while water is supplied. The controller, while the drum rotates, may rotate the pump motor at a first pump rotation speed during the rotation of the drum. When supplying the water by the first set amount to the tub, the controller may control the water supply valve to supply the water supplied to the water supply pipe to the tub via the dispenser. When water is supplied to the tub by the first set amount, the detergent accommodated in the dispenser and water may be supplied to the tub together. The controller, when rotating the drum and the pump motor while supplying water by the first set amount to the tub, may control the driving unit so that the drum repeats rotation and stop and repeat the rotation and stop of the pump motor, and the rotation and stop of the pump motor may be synchronized with the rotation and stop of the drum.

The controller may operate the heater in a state in which the first set amount of water is supplied to the tub. The controller may control the driving unit to rotate the drum at a first drum rotation speed, while operating the heater. The controller may rotate the pump motor at a first pump rotation speed during the rotation of the drum. The controller may control the driving unit so that the drum alternately repeats rotation and stop at the first drum rotation speed, during the operation of the heater.

The controller may stop the operation of the heater. The controller may control the driving unit to rotate the drum at a preset spin-drying speed while the operation of the heater is stopped.

The controller may control the water supply unit to supply water to the tub after rotating the drum at the spin-drying speed. The controller may control the driving unit to rotate the drum at a second drum rotation speed greater than the first drum rotation speed while water is supplied. The controller may accelerate the rotation speed of the pump motor from the second pump rotation speed to the third pump rotation speed. When supplying water to the tub after rotating the drum at the spin-drying speed, the controller may control the driving unit so that the drum alternately repeats rotation and stop at the second rotation speed.

While the drum is rotating at the second drum rotation speed, laundry in the drum may rotate together with the drum without falling even from the highest point of the drum due to the rotation of the drum.

The control method may include: (a) step of performing a first drum operation of supplying water by a first set amount together with a detergent into the tub and rotating the drum at a first drum rotation speed, while water is supplied, at least once and operating the pump at a first pump rotation speed at least once during the first drum operation, (b) step of performing a second drum operation of operating a heater to heat the water in the tub in a state in which the first set amount of water is supplied into the tub, rotating the drum at a first drum rotation speed at least once during the operation of the heater, and operating the pump at the first pump rotation speed at least once during the second drum operation, (c) step of rotating the drum at a preset spin-drying speed to spin-dry laundry, (d) step of operating the drum at a second drum rotation speed greater than the first drum rotation speed, while supplying water into the tub, after the operation of spin-drying the laundry, and accelerating the pump from the second pump rotation speed to a third pump rotation speed.

While the drum is rotating at the first drum rotation speed, the laundry positioned at the lowest point in the drum may rise to a certain height by the rotation of the drum and then roll down along an inner surface of the drum. The first drum rotation speed may be 36 rpm.

In step (a), rotating the drum at the first drum rotation speed may be repeated and operating the pump at the first pump rotation speed may also be repeated, and the operation of the pump and the operation of the drum may be synchronized with each other. In step (a), a ratio of a rotation time and a stop time of the drum may be 30:4.

The third drum rotation speed may be the same as the first pump operation speed.

The second drum rotation speed may be greater than the first drum rotation speed.

In step (b), the ratio of the rotation time and the stop time of the drum may be 36:4.

In step (d), the ratio of the rotation time and the stop time of the drum may be 25:9.

Advantageous Effects

In the control method of the washing machine of the present disclosure, first, by operating the circulation pump in the process of supplying detergent water, a detergent may be actively penetrated into the laundry in the drum.

Second, since heating is performed in a state in which the detergent is evenly permeated into the laundry, heat and chemical action may directly affect the laundry, thereby improving washing power.

Third, a water flow sprayed through the nozzle is shifted in a front-rear direction of the drum through the control of the speed of the circulation pump, and accordingly, the water flow pushes out dirt on the laundry, thereby improving rinsing performance.

BRIEF DESCRIPTION OF THE DRAWINGS

FIG. 6 is a table summarizing data referenced to describe a control method of a washing machine according to an embodiment of the present disclosure.

DESCRIPTION OF EXEMPLARY EMBODIMENTS

Figure 1:
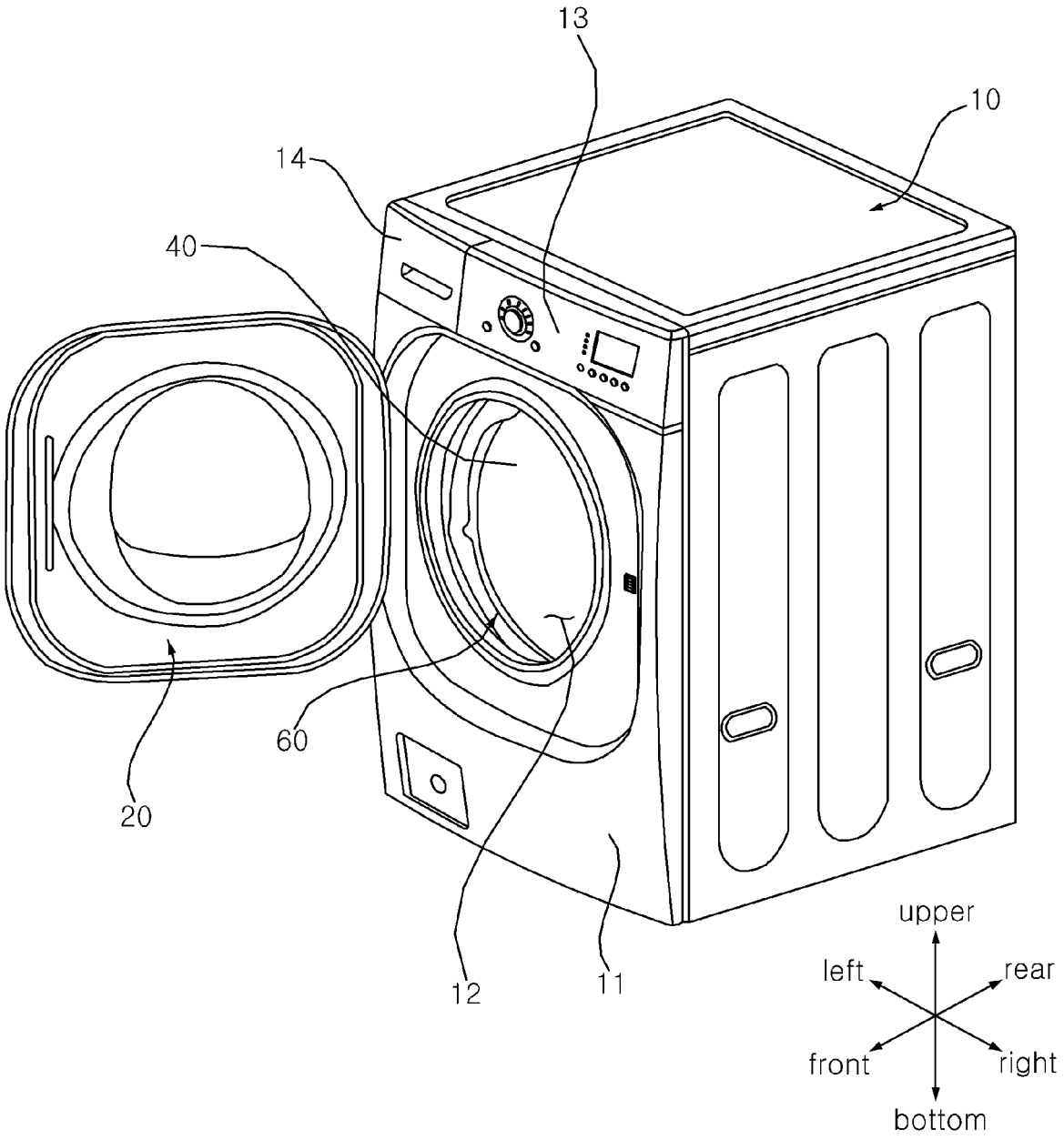
FIG. 1 is a perspective view illustrating a washing machine according to an embodiment of the present disclosure.

Advantages and features of the invention and methods to achieve the same are described more fully hereinafter with reference to the accompanying drawings in which embodiments are shown. This invention may, however, be embodied in many different forms and should not be construed as limited to the embodiments set forth herein. Rather, these embodiments are provided so that this disclosure is thorough, and will fully convey the scope of the invention to those skilled in the art and this invention is defined by the scope of the claims. Like reference numerals refer to like elements throughout the present specification.

Hereinafter, the present disclosure will be described in detail with reference to the accompanying drawings.

Figure 2:
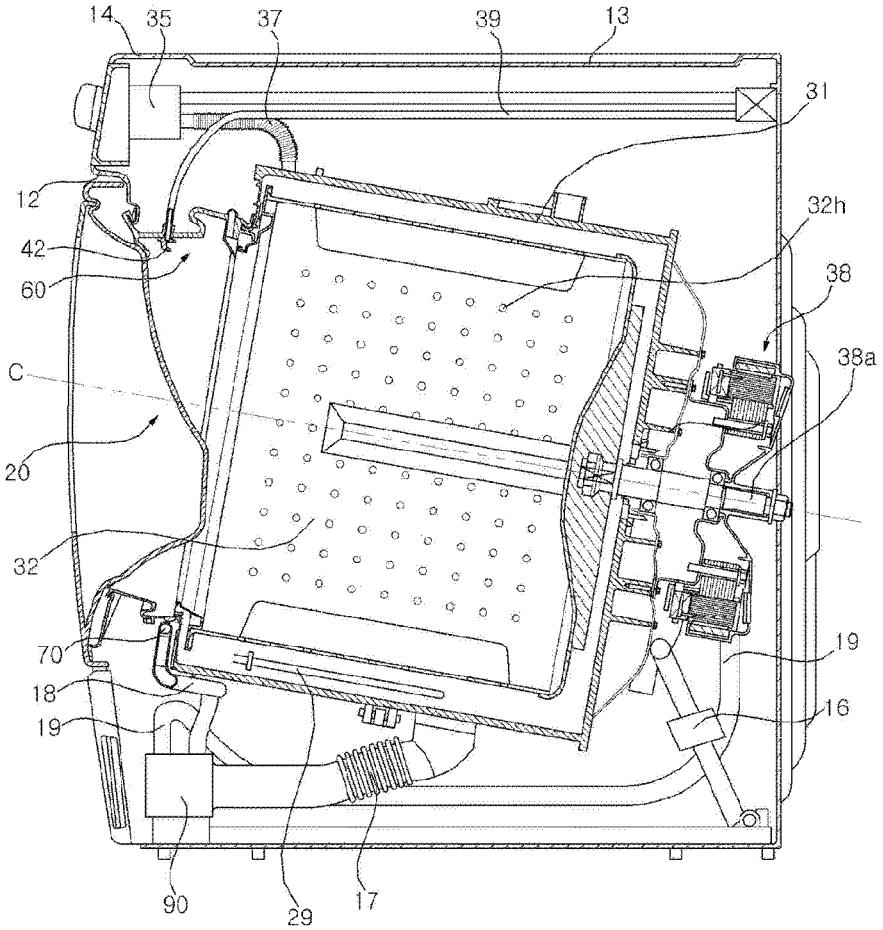
FIG. 2 is a side cross-sectional view illustrating an inside of the washing machine illustrated in FIG. 1.
Figure 3:
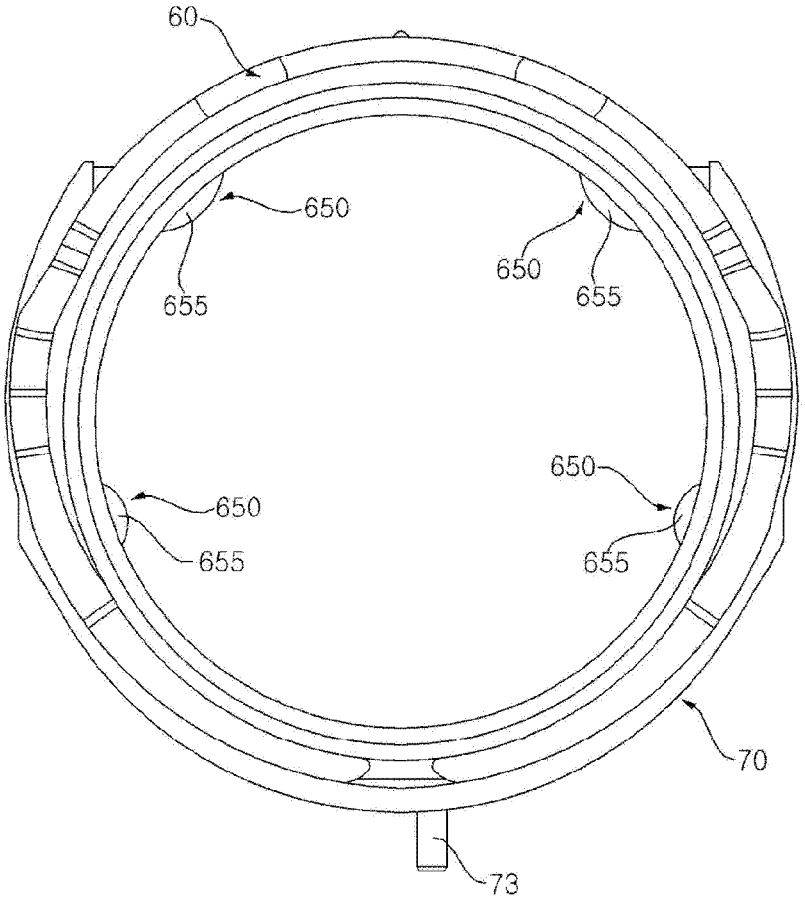
FIG. 3 is a perspective view illustrating a coupling state of a gasket and a distribution pipe illustrated in FIG. 2.
Figure 4:
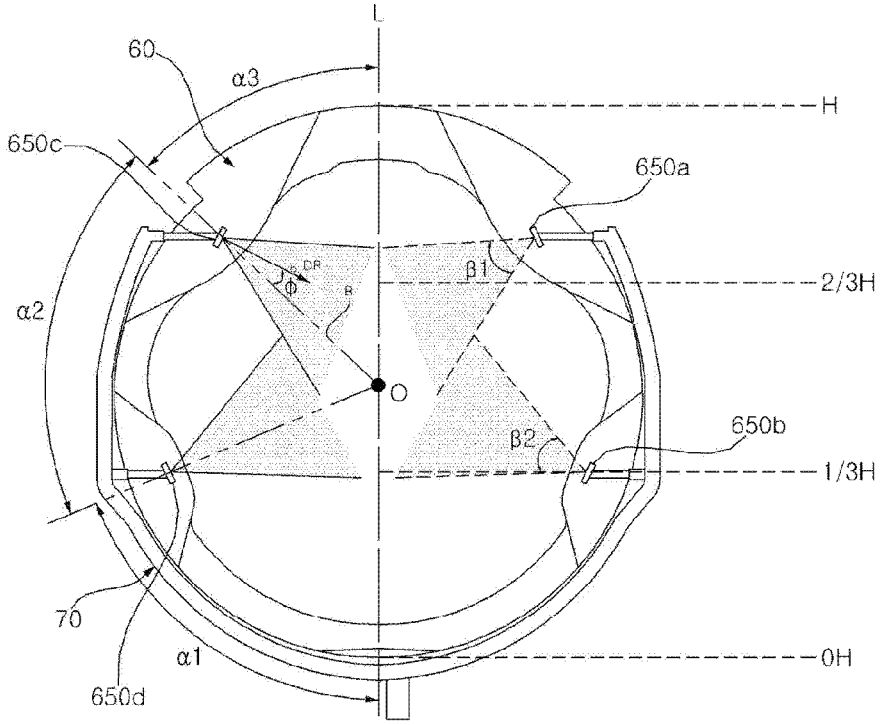
FIG. 4 is a rear view of a gasket, illustrating positions of nozzles and a spray form of each nozzle.

FIG. 1 is a perspective view illustrating a washing machine according to an embodiment of the present disclosure. FIG. 2 is a side cross-sectional view illustrating an inside of the washing machine illustrated in FIG. 1. FIG. 3 is a perspective view illustrating a coupling state of a gasket and a distribution pipe illustrated in FIG. 2. FIG. 4 is a rear view of a gasket, illustrating positions of nozzles and a spray form of each nozzle.

Referring to FIGS. 1 to 3, a casing 10 forms an exterior of a washing machine, and an inlet 12*h* through which laundry is put is formed on a front surface. The casing 10 may include a cabinet 11 having an open front surface, a left surface, a right surface, and a rear surface and a front panel 12 coupled to the open front surface of the cabinet 11 and having the inlet 12*h* formed therein. Bottom and top surfaces of the cabinet 11 are open, and a horizontal base 15 supporting the washing machine may be coupled to the bottom surface. In addition, the casing 10 may further include a top plate 13 covering the open upper surface of the cabinet 11 and a control panel 14 disposed above the front panel 12.

A tub 31 containing water may be disposed inside the casing 10. The tub 31 has an entrance formed in the front so that laundry may be put therein. The cabinet 11 and the tub 31 are connected by an annular gasket 60. A door 20 for opening and closing the inlet 12*h* may be rotatably coupled to the casing 10.

A heater 29 for heating wash water may be provided in the tub 31. The heater 29 may be disposed outside the drum 31.

The gasket 60 is to prevent water contained in the tub 31 from leaking. The gasket 60 may extend from an annular front end to an annular rear end of the to form a tubular passage connecting the inlet 12*h* and the inlet of the tub 41. The front end of the gasket 60 may be fixed to the front panel 12 of the casing 10, and the rear end may be fixed around the entrance of the tub 31.

The gasket 60 may be formed of a flexible or elastic material. The gasket 60 may be formed of natural rubber or synthetic resin. The gasket 60 may be formed of a flexible material such as rubber. The gasket 60 may be formed of a material such as ethylene propylene diene monomer (EPDM) or thermo plastic elastomer (TPE). Hereinafter, a portion defining the inside of the tubular shape of the gasket 60 is referred to as an inner circumferential portion (or an inner circumferential surface) of the gasket 60, and the opposite portion is referred to as an outer circumferential portion (or an outer surface) of the gasket 60.

A drum 32 accommodating laundry may be rotatably provided in the tub 31. A plurality of through-holes 32*h* may be formed in the drum 32 so that water in the tub 31 may be introduced into the drum 32.

The drum 32 is arranged so that the entrance into which the laundry is put is located at the front, and rotates about a substantially horizontal rotation center line C. However, "horizontal" is not a term used in a mathematically strict sense. That is, the rotation center line C inclined at a predetermined angle with respect to the horizontality as in the embodiment may be considered as being substantially horizontal because it is also closer to horizontality rather than verticality. In other words, the rotation center line C may pass through the rear surface of the cabinet 11.

A plurality of lifters 34 may be provided on an inner surface of the drum 32. The plurality of lifters 34 may be disposed at a predetermined angle with respect to a center of the drum 32. When the drum 32 rotates, the laundry is lifted by the lifter 34 and then dropped repeatedly.

A driving unit 38 for rotating the drum 32 may be further provided, and a drive shaft 38*a* rotated by the driving unit 38 may pass through a rear surface of the tub 31 and be coupled to the drum 32.

Preferably, the driving unit 38 may include a direct-connected washing motor, and the washing motor may include a stator fixed to the rear of the tub 31 and a rotor rotated by magnetic force acting between the rotor and the stator. The drive shaft 38*a* may rotate integrally with the rotor.

The tub 31 may be supported by a damper 16 installed on the base 15. Vibration of the tub 31 induced when the drum 32 rotates is attenuated by the damper 16. Although not shown, according to the embodiment, a hanger (e.g., a spring) for suspending the tub 31 in the casing 10 may be further provided.

The water supply unit may supply water supplied from an external water source such as a faucet to the tub 31 or the drum. The water supply unit may include a water supply hose (not shown) for guiding water supplied from an external water source such as a faucet, a water supply pipe 34 for guiding the water supplied through the water supply hose to a dispenser 35, and a water supply valve 33 intermittently controlling the water supply pipe 34.

The dispenser 35 supplies additives such as detergent and fabric softener into the tub 31 or the drum 32. In the dispenser 35, additives may be classified and accommodated according to their types. The dispenser 35 may include a detergent accommodating portion (not shown) for accommodating the detergent and a softener accommodating portion (not shown) for accommodating the fabric softener.

The water supply pipe 34 may include at least one water supply pipe (not shown) for selectively guiding water supplied through the water supply valve 33 to each accommodating portion of the dispenser 35.

The gasket 60 may include a direct water nozzle 42 for spraying water into the drum 32, and a direct water supply pipe 39 for guiding the water supplied through the water supply valve 33 to the direct water nozzle 42.

Water discharged from the dispenser 35 is supplied to the tub 31 through a water supply bellows 37. A water supply port (not shown) connected to the water supply bellows 37 may be formed on a side surface of the tub 31.

A drain hole for discharging water may be formed in the tub 31, and a drain bellows 17 may be connected to the drain hole. A pump 90 for pumping water discharged from the tub 31 through the drain bellows 17 may be provided. A drain valve (not shown) for controlling the drain bellows 17 may be further provided.

In the embodiment, the pump 90 is a circulation pump for drainage and selectively performs a function of pressure-feed water discharged through the drainage bellows 17 to a drain pipe 19 and a function of pressure-feed water to a circulation pipe 18. Since a technique of selectively performing circulation and drainage using a single pump is already well known in the washing machine technology field, a detailed description thereof will be omitted.

However, the present disclosure is not limited thereto, and a drain pump for pressure-feeding water to the drain pipe 19 and a circulation pump for pressure-feeding water to the circulation pipe 18 may be provided separately.

Hereinafter, water pressure-fed by the pump 90 and guided along the circulation pipe 18 is referred to as circulating water.

The pump 90 enables a variable flow rate (or discharge water pressure). A pump motor (not shown) rotating an impeller (not shown) of the pump 90 may be a variable speed motor enabling controlling of a rotation speed. The pump motor may be a brushless direct current motor (BLDC), but is not necessarily limited thereto. A driver for controlling a speed of the pump motor may be further provided, and the driver may be an inverter driver. The inverter driver converts AC power into DC power and inputs the DC power to the motor at a target frequency.

A controller (not shown) for controlling the pump motor may be further provided. The controller may include a proportional-integral (PI) controller, a proportional-integral-derivative (PID) controller, and the like. The controller may receive an output value (e.g., output current) of the pump motor as an input, and control an output value of the driver so that a rotation speed of the pump motor follows a preset target rotation speed based thereon. The controller may control not only the rotation speed of the pump motor, but also a rotation direction.

Meanwhile, it should be understood that the controller may control an overall operation of the washing machine as well as the pump motor and each portion mentioned below is controlled by the controller.

Meanwhile, a nozzle 650 may be disposed on an inner circumferential surface of the gasket 60. The nozzles 650 may be provided in plurality. A plurality of protrusions 655 may be formed on an inner circumferential surface of the gasket 60, and nozzles 650*a*, 650*b*, 650*c*, and 650*d* may be formed on the protrusions 655, respectively.

A distribution pipe 701 for guiding the circulating water pressure-fed by the pump 90 to the plurality of nozzles 650 may be installed in the gasket 60. The distribution pipe 701 may have an entrance connected to the circulation pipe 18 and may have a plurality of exits for guiding water guided through the entrance to the plurality of nozzles 650.

The plurality of nozzles 650 may be classified into upper nozzles 650*a* and 650*c* and lower nozzles 650*b* and 650*d* according to a height from the gasket 60. In the embodiment, four nozzles 650*a*, 650*b*, 650*c*, and 650*d* are provided, which may include a first lower nozzle 650*b* and a second lower nozzle 650*d* disposed below the gasket 60 and a first upper nozzle 650*a* and a second upper nozzle 650*c* disposed above the lower 650*b* and 650*d*.

A water flow sprayed through each of the nozzles 650*a*, 650*b*, 650*c*, and 650*d* reaches a deeper portion of the drum 32 as water pressure supplied from the pump 90 is higher. That is, by controlling a rotation speed of the pump motor (hereinafter referred to as 'pump rotation speed'), a range of the water flow sprayed from the nozzles 650*a*, 650*b*, 650*c*, and 650*d* in the drum 32 may be controlled.

Referring to FIG. 4, when a spray width of a water stream sprayed through the nozzle 650 is defined as a spray width angle, a spray width angle β1 of the upper nozzles 650*a* and 650*c* may be smaller than a spray width angle β2 of the lower nozzles 650*b* and 650*d*.

A difference (β2-β1) between the spray width angle β2 of the lower nozzles 650*b* and 650*d* and the spray width angle β1 of the upper nozzles 650*a* and 650*c* is approximately 4 to 6 degrees, and preferably 5 degrees. At this time, β1 is approximately 38 to 42 degrees, preferably 40 degrees, and β2 is approximately 43 to 47 degrees, preferably 45 degrees.

Meanwhile, a spray direction of the upper nozzles 650*a* and 650*c* may form an upward deviation angle Φ upwardly with respect to a line (R, hereinafter, referred to as a 'nozzle arrangement line') connecting the upper nozzles 650*a* and 650*c* and the center O of the gasket 650*a*. The upward deviation angle Φ may be 5 to 9 degrees, preferably 7 degrees.

Due to various conditions such as the height, position, and spray width angle β1 of the upper nozzles 650*a* and 650*c*, in some cases, the spray is not performed with sufficient water pressure through the upper nozzles 650*a* and 650*c*, so the sprayed water flow may not be able to go straight to a distance. For this reason, by making a spray direction of the upper nozzles 650*a* and 650*c* upward by an upward deviation angle Φ from the nozzle arrangement line R, even when the water pressure of the upper nozzles 650*a* and 650*c* is insufficient, the water flow may reach a region that the nozzle arrangement line (R) passes through, and preferably, a shape of the water flow sprayed through the upper nozzles 650*a* and 650*c* as shown in FIG. 4 and a shape of the water flow sprayed through the lower nozzles 650*b* and 650*d* may be substantially symmetrical up and down.

Meanwhile, assuming that an angle from the lowest point of the gasket 60 to the lower nozzles 650*b* and 650*d* is α1, the upper nozzles 650*a* and 650*c* are between a highest point H of the gasket 60 from a position corresponding to the angle αl but it may be located above a point corresponding to an angle obtained by dividing 180−α1 into equal parts. That is, in FIG. 4, α2 has a larger value than α3. α2-α3 may be 18 degrees to 22 degrees, preferably 20 degrees. In this case, α2 may be 63 degrees to 67 degrees, preferably 65 degrees.

Meanwhile, the lower nozzles 650*b* and 650*d* may be positioned at about ⅓ point (⅓H) of the height H of the gasket 60. In this case, α2 is preferably set in a range in which the upper nozzles 650*a* and 650*c* are located higher than ⅔ (⅔H) of the height of the gasket 60. In this case, α2 may be 65 degrees.

In order to evenly spray the circulating water up and down in the drum 32, the upper nozzles 650*a* and 650*c* and the lower nozzles 650*b* and 650*d* are preferably arranged at equal intervals in the height direction, but in this case, there is a problem in that the water flow sprayed from the upper nozzles 650*a* and 650*c* actually reaches a lower region than that geometrically predicted due to deflection of the water flow. Therefore, when considering the deflection of the water flow due to gravity, the upper nozzles 650*a* and 650*c* need to be disposed higher than ⅔H.

Meanwhile, when the pump 901 is operated and the circulating water is sprayed through the lower nozzles 650*b* and 650*d*, a water level in the tub 31 preferably does not exceed the ⅓H point.

Figure 5:
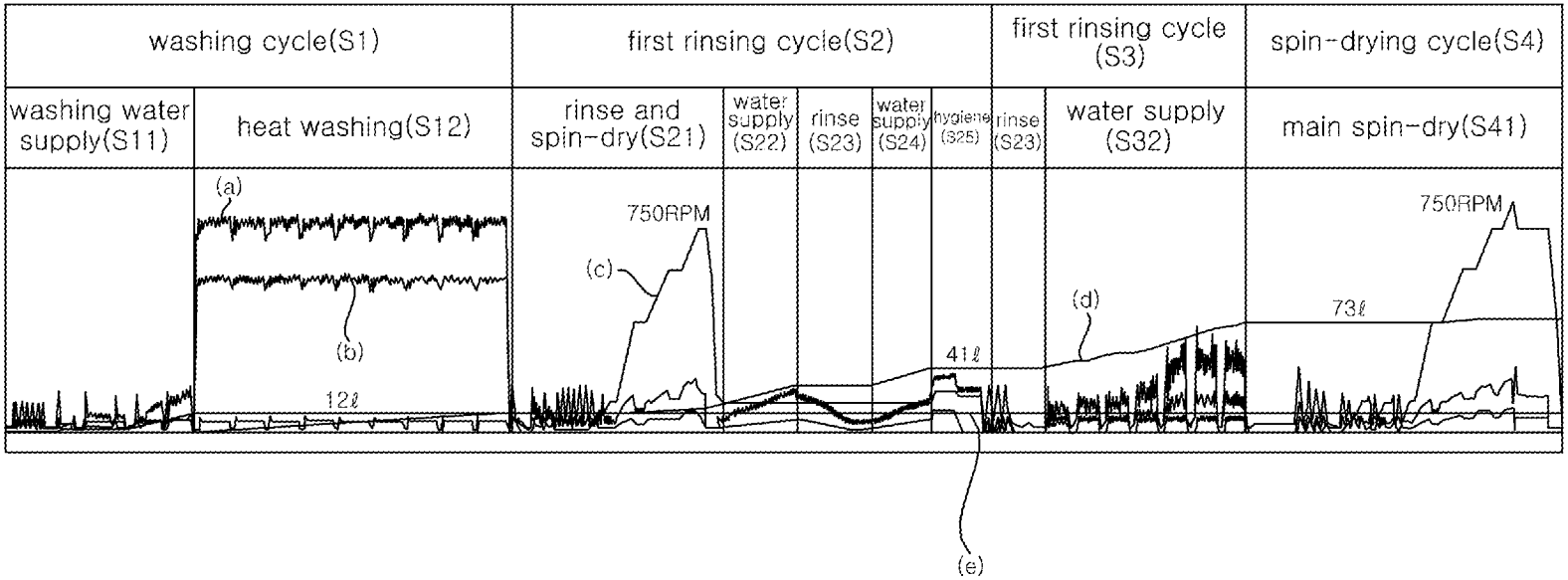
FIG. 5 is graphs referenced to describe a control method of a washing machine according to an embodiment of the present disclosure.

FIG. 5 is graphs referenced to describe a control method of a washing machine according to an embodiment of the present disclosure, in which (a) is current (W), (b) is electric power, C is a rotation speed of the drum, (d) is the amount of supplied water, and (e) represents electrical energy Wh. In particular, the current a, the electric power c, and the electrical energy Wh indicate a total amount consumed by the washing motor, the pump motor, and the heater 29.

FIG. 6 is a table summarizing data referenced to describe a control method of a washing machine according to an embodiment of the present disclosure. Hereinafter, a control method of a washing machine according to an embodiment of the present disclosure will be described with reference to FIGS. 5 to 6.

The control method of a washing machine according to an embodiment of the present disclosure may include a washing cycle (S1), a first rinsing cycle (S2), a second rinsing cycle (S3), and a spin-drying cycle (S4).

The first washing cycle (S1) may include washing water supply (S11) and heat washing (S12). The washing water supply (S11) is a step of supplying water into the tub 31, in which the water supply valve 33 is opened under the control of a controller (not shown). Water is supplied to the dispenser 35 through the water supply pipe 34, and the additive (detergent) contained in the dispenser 35 may be discharged together with the water.

The controller may control various electric devices constituting the washing machine and may include a memory for storing a coded program and a processor for processing data by reading the memory. Hereinafter, it should be understood that 'control' is performed by the controller even if there is no particular mention.

At the time of washing water supply (S11), a first set amount (e.g., 12 liters (l)) of water is supplied into the tub 31, and a first drum operation is performed while the water is supplied in this manner. During the first drum operation, rotating the drum 32 at a first drum rotation speed (36 rpm in the table of FIG. 6) is performed at least once. In addition, operating the pump 90 at a first pump rotation speed during the first drum operation may be performed at least once.

The first pump rotation speed may be a pump rotation speed when a current of 1.1 A is applied to the pump motor. A time required for the washing water supply (S11) may be about 4 minutes.

While the drum 32 is rotated at the first drum rotation speed, the laundry located at the lowest point in the drum 32 may move in a manner of rising to a certain height by the rotation of the drum 32 and then rolling down along the inner surface of the drum 32. Hereinafter, the motion of the laundry is referred to as a rolling motion. The first drum rotation speed may be 36 rpm. Since the laundry rubs against the inner surface of the drum 32 or the lifter 34 while the rolling motion is induced, it has the same effect as rubbing the laundry.

The rotation of the drum 32 (i.e., rotation at the first drum rotation speed) causing the rolling motion as described above may be repeated a plurality of times. In this case, a ratio (t11:t12) of a time t11 for which the drum 32 is rotated once and a time t12 for which the drum 32 is stopped once may be 30:4. For example, a pattern in which current is applied to the washing motor for 6 seconds and then cut off for 4 seconds may be repeated.

Rotating the pump 90 at the first pump rotation speed in the washing water supply (S11) operation may be repeated. Here, the operation of the pump 90 when the pump 90 is rotated at the first pump rotation speed may be controlled to be synchronized with the operation of the drum 32. That is, a current may be applied to the pump motor in response to a current being applied to the washing motor, and a current applied to the pump motor may also be cut off in response to cutoff of the current applied to the washing motor.

In the heat washing (S12), the heater 29 is operated in a state in which a first set amount of water is supplied into the tub 31, and the second drum operation is performed while the heater 29 is operated. During the operation of the second drum, rotating the drum 32 at the first drum rotation speed (36 rpm in the table of FIG. 6) is performed at least once. Also, while the second drum operation is performed, a pump constant speed operation for rotating the pump 90 at the first pump rotation speed is performed at least once. A time required for heat washing (S12) may be approximately 8 minutes.

In the heat washing (S12), a ratio (t21:t22) of a time t21 for which the drum 32 is rotated once and a time t22 for which the drum 32 is stopped once may be 36:4. For example, a pattern in which current is applied to the washing motor for 36 seconds and then cut off for 4 seconds may be repeated.

In the heat washing (S12), a ratio (t31:t32) of a time t31 for which the pump 90 is operated once and a time t32 for which the pump 90 is stopped once may be 14:4. For example, a pattern in which current is applied to the pump motor for 14 seconds and then cut off for 4 seconds may be repeated.

The first rinsing step (S2) may include a rinsing and spin-drying step (S21), a water supply step (S22), a draining step (S23), a water supply step (S24), and a hygiene step (S25).

The rinsing and spin-drying step (S21) may be a step of spin-drying laundry by rotating the drum 32 at a preset spin-drying speed. As the laundry rotates while being adhered to the inner surface of the drum 32, spin-drying is performed.

The pump 90 may be operated in an open state of the drain valve. At this time, the pump 90 may be operated in a drain mode to discharge wash water through the drain pipe 19. In the rinsing and spin-drying step (S21), the drum 32 may be accelerated by stages to reach a spin-drying speed. However, the drum 32 may be accelerated to the spin-drying speed at a time, without being limited thereto. The spin-drying speed is preferably 750 rpm, but is not necessarily limited thereto. A time required for the rinsing and spin-drying (S21) may be approximately 8 minutes. The pump 90 may be operated while the rinsing and spin-drying (S21). At this time, the pump motor may be operated in a state of being synchronized with the washing motor.

After the rinsing and spin-drying step (S21), the water supply step (S22) may be performed. In the water supply step (S22), water as much as a second set amount is supplied into the tub 31, and in this process, the drum 32 may be operated at a second drum rotation speed. The second drum rotation speed may be a speed at which the laundry in the drum 32 rotates in a state of adhering to the inner circumferential surface of the drum 32 by centrifugal force induced by the rotation of the drum 32 (hereinafter referred to as 'filtration motion'). While the drum 32 is rotated at the second drum rotation speed, the laundry in the drum 32 may rotate together with the drum 32 without falling even from the highest point of the drum 32 due to the rotation of the drum 32. The second drum rotation speed may be, for example, 108 rpm. A time required for water supply (S22) may be approximately 40 seconds.

While the drum 32 is operated in the filtration motion, the pump 90 may be accelerated from the second pump rotation speed to the third pump rotation speed. At this time, the current value applied to the pump motor may be increased from 0.3 A to 1.1 A. In this case, the pump motor may be controlled to be synchronized with the washing motor.

After the water supply (S22), draining (S23) may be performed. The drain valve may be opened to perform draining. During draining (S23), the drum 32 may be rotated at the second drum rotation speed.

After the draining (S23), water supply (S24) by the third set amount may be performed in a state in which the drain valve is closed. In a state in which the drain valve is closed, the water supply valve 33 is opened, and at this time, the drum 32 may be in a stopped state.

After the water supply (S24), hygiene (S25) may be performed. The hygiene (S25) is to perform a filtration motion in a state in which the tub 31 is filled with water due to the water supply (S24). At this time, the tub 31 should be filled with water enough to submerge a lower portion of the drum 31. The drum 32 is rotated at the third drum rotation speed, and in this process, a water flow is formed along the inner surface of the tub 31 while being rotated by friction with the drum 32, and the drum 32 and the tub 31 are cleaned by the water flow. The third drum rotation speed may be 150 rpm. As in the embodiment, even when a front portion of the drum 32 is higher than a rear portion because a rotation center line C of the drum 32 is inclined, when the drum 32 rotates at 150 rpm, the water flow that rises in the tub 31 may extend to the front portion of the drum 32.

Meanwhile, after the drum 32 is rotated at the third drum rotation speed, the drum 32 may be decelerated at the fourth drum rotation speed and rotated. The fourth drum rotation speed may be 130 rpm.

Including rotating the drum 32 at the third drum rotation speed and rotating the drum 32 at the fourth drum rotation speed, the hygiene S25 may be performed for approximately 1 minute.

Meanwhile, a total amount of water supplied from the water supply (S22) and the water supply (S24) may be approximately 29 liters (l).

After the rinsing (S23), a second rinsing cycle (S3) may be performed. The second rinsing cycle (S3) may include drainage (S31) and water supply (S32).

As for the drain S31, the pump 90 may be operated in an open state of the drain valve. At this time, the pump 90 may be operated in the drain mode to discharge the wash water through the drain pipe 19. The drum 32 may be in a stationary state while draining is taking place. Drainage (S31) may be performed for 1 minute.

In the water supply (S32), a fourth set amount (e.g., 32 liters (l)) of water is supplied into the tub 31, and in this process, driving the drum 32 at the fifth drum rotation speed is at least 1 It may be carried out several times. The time required for water supply (S32) may be 2 minutes.

While the drum 32 is rotated at the third drum rotation speed, the laundry located at the lowest point in the drum 32 may move in a pattern of rising to a certain height by the rotation of the drum 32 and then being separated from the inner surface of the drum 32 to fall. Hereinafter, such a motion of the laundry is referred to as a tumbling motion. The third drum rotation speed may be 46 rpm. Since the tumbling motion causes the laundry to fall, it has the same effect as washing the laundry by tapping.

The rotation of the drum 32 (i.e., rotation at the fifth drum rotation speed) causing the tumbling motion may be repeated a plurality of times. In this case, a ratio (t41:t42) of a time t41 for which the drum 32 is rotated once and a time t42 for which the drum 32 is stopped once may be 25:9. For example, a pattern in which current is applied to the washing motor for 25 seconds and then cut off for 9 seconds may be repeated.

In the water supply step (S32), the pump 90 may be operated in a speed shifting manner. At this time, the current value applied to the pump motor may vary between 0.5 A and 1.1 A. In the water supply step (S32), the speed shifting operation of the pump 90 may be repeated at regular time intervals. At this time, the operation of the pump motor may be controlled to be synchronized with the washing motor.

A current having a pattern of increasing from 0.5 A to 1.1 A and then falling back to 0.5 A at least once is applied to the pump 90 for a predetermined time t41 and then cut off for a predetermined time t42. For example, a pattern in which current is applied to the pump 90 for 25 seconds and then cut off for 9 seconds may be repeated. A time required for water supply (S32) may be approximately 2 minutes.

After the water supply (S32), the spin-drying process (S4) may include main spin-drying (S41) and cloth unwinding (S42). The main spin-drying (S41) may be a step of spin-drying laundry by rotating the drum 32 at a preset spin-drying speed. As the laundry rotates while being adhered to the inner surface of the drum 32, spin-drying is performed.

The pump 90 may be operated in a state in which the drain valve is opened. At this time, the pump 90 may be operated in the drain mode to discharge the wash water through the drain pipe 19. In the main spin-drying step (S41), the drum 32 may be accelerated by stages to reach the spin-drying speed. However, the spin-drying speed may be accelerated at a time without being limited thereto. The spin-drying speed is preferably 750 rpm, but is not necessarily limited thereto. A time required for the main spin-drying (S41) may be approximately 12 minutes.

What is claimed is:

1. A washing machine comprising:

a tub configured to store water;

a drum rotatably provided in the tub;

a driving motor configured to rotate the drum;

a water supply configured to supply water supplied from an external water source to the tub;

a pump comprising a pump motor, the pump being configured to pressure-feed water discharged from the tub;

a nozzle configured to spray the water pressure-fed by the pump into the drum;

a heater configured to heat the water in the tub; and a controller configured to control the driving motor, the water supply, the pump motor, and the heater, wherein the controller is configured to:

perform a first operation in which the controller controls the water supply to supply a first set amount of water to the tub, controls the driving motor to rotate the drum at a first drum rotation speed while water is being supplied, and rotates the pump motor at a first pump rotation speed while rotating the drum at the first drum rotation speed, perform a second operation in which the controller operates the heater in a state in which the first set amount of water is supplied to the tub, and controls the driving motor to rotate the drum at the first drum rotation speed while operating the heater and rotating the pump motor at the first pump rotation speed, stop an operation of the heater, and control the driving motor to rotate the drum at a preset spin-drying speed in a state in which the operation of the heater is stopped, control the water supply to supply water to the tub after rotating the drum at the preset spin-drying speed, while controlling the driving motor to rotate the drum at a second drum rotation speed greater than the first drum rotation speed, and accelerating the pump motor from a second pump rotation speed to a third pump rotation speed, and control a stop period and a rotation period of the pump motor during each of the first operation and the second operation, and wherein a ratio of the stop period of the pump motor to the rotation period of the pump motor during the second operation is greater than a ratio of the stop period of the pump motor to the rotation period of the pump motor during the first operation.

2. The washing machine of claim 1, wherein the water supply includes:

a water supply pipe configured to receive water from the external water source;

a water supply valve configured to control the water supply pipe; and a dispenser configured to accommodate a detergent and connected to the water supply pipe and the tub.

3. The washing machine of claim 1, wherein, while the drum is rotating at the first drum rotation speed, laundry positioned at the lowest point in the drum rises to a certain height by the rotation of the drum and then rolls down along an inner surface of the drum.

4. The washing machine of claim 1, wherein the first drum rotation speed is 36 rpm.

5. The washing machine of claim 1, wherein the controller is configured to, based on rotating the drum and the pump motor while supplying the first set amount of water to the tub, control the driving motor to cause the drum to repeat rotation and stop and to cause the pump motor to repeat rotation and stop, and wherein the rotation and stop of the pump motor are synchronized with the rotation and stop of the drum during the first operation.

6. The washing machine of claim 5, wherein, during the first operation, when the first set amount of water is supplied to the tub, a ratio of a rotation period of the drum to a stop period of the drum is 30:4.

7. The washing machine of claim 1, wherein the third pump rotation speed is equal to the first pump rotation speed.

8. The washing machine of claim 1, wherein the controller is configured to control the driving motor to cause the drum to alternately repeat rotation and stop at the first drum rotation speed while operating the heater, and wherein a ratio of a rotation period of the drum to a stop period of the drum is 36:4.

9. The washing machine of claim 1, wherein the controller is configured to, based on supplying water to the tub after rotating the drum at the preset spin-drying speed, control the driving motor to cause the drum to alternately repeat rotation and stop at the second drum rotation speed, and wherein a ratio of a rotation period of the drum to a stop period of the drum is 25:9.

10. The washing machine of claim 1, wherein, while the drum is rotating at the second drum rotation speed, laundry in the drum rotates together with the drum without falling even from the highest point of the drum due to the rotation of the drum.

11. The washing machine of claim 1, wherein the controller is configured to control a stop period and a rotation period of the drum during each of the first operation and the second operation, and wherein a ratio of the stop period of the drum to the rotation period of the drum during the first operation is equal to a ratio of the stop period of the drum to the rotation period of the drum during the second operation.

12. The washing machine of claim 11, wherein, during the first operation, the ratio of the stop period of the pump motor to the rotation period of the pump motor is equal to the ratio of the stop period of the drum to the rotation period of the drum.

13. The washing machine of claim 11, wherein, during the second operation, the ratio of the stop period of the pump motor to the rotation period of the pump motor is greater than the ratio of the stop period of the drum to the rotation period of the drum.

14. A control method of a washing machine including a drum configured to rotate about a horizontal rotation axis in a tub and a plurality of nozzles configured to spray water discharged from the tub and circulated by a pump into the drum, the control method comprising:

performing a first drum operation of supplying a first set amount of water together with a detergent into the tub while rotating the drum at a first drum rotation speed;

operating the pump at a first pump rotation speed during the first drum operation;

performing a second drum operation of operating a heater to heat the water in the tub in a state in which the first set amount of water is supplied into the tub, while controlling the drum to rotate at the first drum rotation speed and controlling the pump to rotate at the first pump rotation speed;

rotating the drum at a preset spin-drying speed to spin-dry laundry;

operating the drum at a second drum rotation speed greater than the first drum rotation speed, while supplying water into the tub after rotating the drum at the preset spin-drying speed, and accelerating the pump from a second pump rotation speed to a third pump rotation speed; and controlling a stop period and a rotation period of the pump during each of the first drum operation and the second drum operation, wherein a ratio of the stop period of the pump to the rotation period of the pump during the second drum operation is greater than a ratio of the stop period of the pump to the rotation period of the pump during the first drum operation.

* * * * *